United States Patent [19]

Hirt et al.

[11] 4,351,713

[45] Sep. 28, 1982

[54] ELECTRO-CO-DEPOSITION OF CORROSION RESISTANT NICKEL/ZINC ALLOYS ONTO STEEL SUBSTRATES

[75] Inventors: Theodore A. Hirt; Robert H. Dillon, both of Warren, Ohio

[73] Assignee: Thomas Steel Strip Corp., Warren, Ohio

[21] Appl. No.: 240,760

[22] Filed: Mar. 5, 1981

Related U.S. Application Data

[62] Division of Ser. No. 68,877, Aug. 22, 1979, Pat. No. 4,282,073.

[51] Int. Cl.[3] ..... C25D 17/00

[52] U.S. Cl. ..... 204/207

[58] Field of Search ..... 204/206, 207

[56] References Cited

U.S. PATENT DOCUMENTS

| | | | |
|---|---|---|---|
| 2,080,506 | 5/1937 | Rinck et al. | 204/207 |
| 2,377,550 | 6/1945 | Hall | 204/207 |
| 2,419,231 | 4/1947 | Schantz | 204/43 Z |
| 3,420,754 | 1/1969 | Roehl | 204/28 |
| 3,558,442 | 1/1971 | Roehl et al. | 204/43 Z |
| 3,691,027 | 9/1972 | Hartford et al. | 204/43 Z |

FOREIGN PATENT DOCUMENTS

| | | | |
|---|---|---|---|
| 779888 | 7/1957 | United Kingdom | 204/43 Z |
| 825031 | 12/1959 | United Kingdom | 204/43 Z |
| 1224680 | 3/1971 | United Kingdom | 204/43 Z |
| 1229932 | 4/1971 | United Kingdom | 204/43 Z |
| 2032961 | 5/1980 | United Kingdom | 204/43 Z |

*Primary Examiner*—T. M. Tufariello

*Attorney, Agent, or Firm*—Ernest F. Marmorek

[57] ABSTRACT

Novel plating baths and the processes for plating therewith are disclosed which provide corrosion-resistant nickel/zinc alloy coatings containing 13–15 weight/% of nickel for iron or steel substrates. The novel baths have combined nickel and zinc contents in the range of 14 to 24 ounces of metal per gallon with the ratio of nickel to zinc maintained in the range 0.1:0.4. These baths permit satisfactory plating of the alloy to be achieved at current densities in the range 30 to 120 amperes per square foot. At alloy coating thicknesses in the range 0.00005 to 0.0005 inches, a salt spray corrosion resistance in excess of 0.5 hours per microinch is afforded. Additionally, by coating the substrate, before alloy plating, with a substantially pure nickel priming layer, the corrosion resistance rate can be effectively doubled. Apparatus for the continuous plating of the priming layer and the corrosion-resistant alloy layer is also described.

3 Claims, 2 Drawing Figures

FIG 1

ELECTRO-CO-DEPOSITION OF CORROSION RESISTANT NICKEL/ZINC ALLOYS ONTO STEEL SUBSTRATES

This is a division, of application Ser. No. 68,877, filed Aug. 22, 1979 now U.S. Pat. No. 4,282,073.

FIELD OF THE INVENTION

This invention relates to improvements in corrosion resistance of steel surfaces and more particularly to the protection of such surfaces by the direct electro-co-deposition of nickel/zinc alloys thereon.

BACKGROUND OF THE INVENTION

The tendencies of iron or steel surfaces to corrode is well known. Zinc is one of the most widely used metallic coatings applied to steel surfaces to protect them from corrosion. In the past, the principal methods of applying such coatings were hot-dipping, also known as galvanizing; and the electroplating of a zinc layer onto the steel. The hot-dip method, while inexpensive and easily applied, resulted in the coating having a thickness of 0.001 inch or more. These coatings, at the temperatures of application, have a tendency to partially alloy at the interface with the steel substrate. The interface alloys are brittle and as a result so-coated materials are not suitable for many forming and finishing operations.

Electroplated zinc produces thinner coatings, about one-tenth the thickness of the hot-dipped coatings, and, it is applied at lower temperatures, causes little or no alloying at the interface between the electroplated zinc layer and the steel substrate. Where rigorous forming and finishing steps are required, such as hot or cold drawing, it is preferred to apply the corrosion-resistant coating by electroplating.

Zinc has been electroplated on the steel surfaces from various plating baths, preferably from acid plating baths, for providing protection of steel surfaces for various uses. The electroplated steel is used for so many varied purposes that the zinc is usually applied to continuous steel strips which, after being plated, are then fabricated into the final articles of manufacture by the conventional cutting, stamping, drawing, forming and finishing operations. However, pure zinc when very thinly applied to steel provides only minimal corrosion protection.

It has been known as in the U.S. Pat. No. 2,419,231 to Shanz, owned by the predecessor of the present assignee, to improve the corrosion resistance of the coating layer by using for the coating an alloy high in zinc and low in nickel. This alloy is co-deposited from the electrolytic plating bath onto the steel substrate. The co-deposition of the high zinc/low nickel alloy is provided by the addition of nickel salts to an acid zinc-plating bath and then plating at current densities above about 25 amperes per square foot. It was noted that such a plated coating on steel provides superior corrosion resistance to that provided by pure zinc alone.

The nickel/zinc alloy compositions suggested by Shanz range from 10 percent to 24 percent nickel with the remainder zinc. To promote adherence of these nickel-zinc alloys ranging in nickle content from 10 percent to 24 percent with 11 percent to 18 percent nickel being preferred, Shanz recommends that the steel surface first be primed with a thin coating of substantially pure nickel ranging from 0.000025 to 0.00010 inches in thickness. In addition to the improved adherance of the plated alloy, Shanz postulates that some degree of protection against corrosion is provided by the pure nickel "strike" layer since nickel is electronegative to steel and probably at least slows down the electrolytic action between the anodic alloy and the base metal where the latter is exposed. For many years the Shanz co-deposition procedure was followed, usually without the nickel strike layer.

An improvement on the aforementioned Shanz procedure was provided by Roehl in U.S. Pat. No. 3,420,754 also commonly owned. Roehl pointed out that the alloy range used by Shanz for corrosion resistance was an alloy which in addition to being poorly adherant was also insufficiently ductile. Continuous steel strip, alloy-plated in accordance with the teaching of Shanz, when subjected to forming and finishing operations tended to form cracks in the coating because of the brittleness of the alloy. Its relatively high internal stress was the postulated reason. Roehl proposed to solve this shortcoming of the Shanz alloy by restricting the co-deposition to alloys containing less than 10% of nickel. Roehl stated that with less than 10% nickel in the alloy, the plated alloy coatings were more ductile and thus the reduced stress concentration provided a more suitable steel strip for forming and drawing operations.

A subsequent improvement by Roehl et al. In U.S. Pat. No. 3,558,442 also commonly assigned, is based on the stated premise than an improvement in corrosion resistance of the low nickel alloy of the Roehl U.S. Pat. No. 3,420,754 could be obtained if the nickel content of the electro-deposited alloy were slightly increased to a maximum of about 12.5% nickel if deposited from an alloy plating bath maintained at a specific pH range. This alloy deposited from such baths would still adhere directly to the steel substrate and would still provide corrosion-resistant alloy coating on the steel having sufficient ductility to permit conventional forming and finishing operations. Roehl et al. postulated that while the corrosion-resistance on the stressed specimens was slightly decreased due to the higher nickel content, the "deposit stress" would remain within the acceptable limit previously unavailable for the same alloys deposited from other baths having other compositions and under different pH conditions.

The aforementioned commonly owned Roehl and Roehl et al. patents have been the industrial standards for providing nickel-zinc alloy corrosion-protection to continuous steel strip and other steel substrates.

However, as in all matters pertaining to corrosion-resistance, any expedient which lengthens the corrosion-resistance of the article is a desirable improvement.

It has been noted that considerable variations in the composition of the deposited alloy have been noted. Apparently these are caused by variations of the current density during the plating operation.

Further, at very high plating current densities there is a tendency of the alloy deposit to assume a "burned" texture or quality.

When utilizing the baths of the prior art under the conditions recommended in the Roehl patent, it was also found that when any interruption in the "continuous" plating operation or when the strip was immersed in the plating baths without plating current or if the plated strip, wet with the bath were exposed to air, a dark stain formed, due probably to an immersion-deposit of oxidized nickel salts on the alloy surface. While under normal running conditions, these were not a serious problem, however when the plating line was stopped due to production contingencies an objectionable stain rapidly formed which devalued the resultant product.

The baths utilized in the above-mentioned prior art ranged from seven to nine ounces of nickel (as the metal) per gallon used by Shanz, to from four to five ounces of nickel per gallon in the Roehl and Roehl et al. patents. In addition, the Shanz patent provided a total maximum metal content (nickel plus zinc) of 18 ounces per gallon whereas in the Roehl and Roehl et al. patents the total metal content ranged up to 14 to 15 ounces per gallon. The ratios of nickel: zinc used in the Shanz patent ranged from 0.77:1 to 1.3:1. The Roehl and Roehl et al. patents recommend ratio ranges of 0.40:1 to 0.625:1 and 0.44:1 to 0.7 respectively.

OBJECT OF THE INVENTION

It is an object of this invention to provide improved corrosion-resistant composites consisting of iron, preferably steel, substrates coated with corrosion-resistant alloy composites.

It is a further object of this invention to provide compositions from which suitable uniform alloy compositions for the aforementioned composites may be plated despite variations in the current density at which the composites are deposited.

It is a further object of this invention to provide new methods and plating compositions whereby uniform composites may be plated which are free from "burned" areas which are embrittled areas of rough or powdery alloy deposits.

It is another object of this invention to provide plating baths which will reduce staining of the deposits during current interruptions or non-uniform plating conditions.

It is a further object of this invention to provide apparatus and plating baths therefor whereby economic procedures may be practiced in the preparation of the desired corrosion-resistant composites according to this invention.

These and other objects are achieved by the present invention which will be more fully and completely described hereinafter in conjunction with both the general description, the appended examples and the drawing of which FIG. 1 is a curve showing the mixed composition of the deposited alloy as a function of the cathodic current density in amperes per square foot; and FIG. 2 is a schematic diagram of a continuous plating line for use in the practice of this invention wherein steel strip is first plated with a nickel strike and is then overcoated with an alloy composition consisting essentially of nickel and zinc within stated proportions from the novel baths according to this invention.

THE INVENTION

The above and other objects of this invention are achieved by a novel method of protecting steel surfaces with an improved corrosion-resistant nickel/zinc alloy coating which comprises the plating process for deposition of said alloy coating which includes the steps of immersing the iron or steel surface to be protected in an aqueous plating bath having a pH of from about 3 to about 4 in which soluble nickel and zinc salts have been dissolved in amounts for each gallon of the bath to have a content of zinc metal equivalent of from about 10 to about 20 ounces and a content of nickel metal equivalent of from about 2 to about 4 ounces. The nickel:zinc ratio must be in the range of 0.2:1 to 0.45:1 and the total combined metal content of nickel and zinc should exceed 14 ounces per gallon. The iron or steel surface is made cathodic in the plating bath with the electroplating current density maintained at from 15 to 110 amperes per square foot to thereby electrodeposit a nickel/zinc alloy coating on the iron substrate. The nickel/zinc alloy has a nickel concentration of from 9.5% to 13% by weight, the remainder being zinc. The alloy coating is adherent, maleable and has a corrosion resistance at least equal to that resulting from coatings deposited from baths having lower total metal contents, lower zinc contents and a lower pH. It has been found that these novel baths have a lesser tendency to stain or form "burned" deposits.

According to another aspect of this invention, we have found that the corrosion-resistance of the steel surface can be greatly improved, as measured by the standard salt-spray corrosion test, if the above-mentioned alloy is plated from the novel baths, according to the novel process mentioned above, onto the substrate which had previously been coated with a thin nickel layer of from 0.000005 inches to 0.00005 inches thickness in the form of a nickel priming or "strike" layer. Preferably such a priming layer is formed by electrodeposition. Other methods including electroless baths or vapor deposition may be used for the application of this layer.

We have found that by depositing the alloy on such a primed surface that the corrosion-resistance time, as measured in the salt-spray test is at least doubled.

According to another aspect of this invention, we have found that we can continuously deposit the aforementioned layers on steel strip either in the form of the corrosion-resistant alloy layer alone or with the corrosion-resistant layer deposited after the priming layer is plated on said steel strip. According to this novel process, these depositions can be continuously applied while the steel strip is continuously advancing at a uniform speed through the novel apparatus according to this invention.

We have also found that as a result of the novel baths containing the total amounts of combined metals at the novel ratios of nickel to zinc, at the pH ranges set forth, provide uniform deposition of the alloy composition even when operating at current density ranges of as low as 15 amperes per square foot. With previous plating bath compositions, it was difficult to obtain alloy compositions containing less than 15% nickel when the baths were operated below the 40 amperes per square foot current densities as recommended in the prior art.

While the current densities below about 40 amperes per square foot are lower than those that are in general use commercially in a continuous strip-plating line, the strip in its usual passage through the alloy plating baths that were previously provided is exposed to areas of very low current densities as it travels through the line. In such low current densities areas in the baths of the prior art, there often resulted nickel-rich alloy inclusions which seriously affected the quality of the resultant plate. It is recognized that deposits or inclusions in the alloy layer wherein the nickel content is higher than about 18%, tend to cause stress concentrations, thus become brittle, and an alloy deposit having inclusions of high nickel content is thus undesirable.

Reference to FIG. 1 clearly shows that the bath of the present invention, when operated at the current densities above about 15 amperes per square foot, provides a uniform alloy composition in the range of 9.5% to 12% nickel content. This is completely within the desirable parameter for optimized corrosion-resistance with adequate maleability for further forming operations on the steel strip.

It is also recognized that at very high current densities, nickel plating baths and particularly baths of the nickel/zinc alloy yield a "burned" alloy deposit. This burned deposit is an area of a powdery, rough and discolored deposit. Such localized burned areas are caused by the depletion of the metal ions in the electrolyte near the cathode. Previously, attempts have been made to correct these faults by increasing the temperature of the plating bath to cause higher ion mobility; or to increase agitation to provide more uniform metal ion concentrations in the bath. The novel bath compositions of the present invention provide higher total metal ion concentration and also permit a higher operating temperature.

Another cause of these unsound high current-density deposits is the rise of the pH of the solution in the film adjacent the cathod. Because the nacent hydrogen formed in this film chemically reduces the metal, rather than permitting its electrodeposition, the reduced metal precipitates rather than plates onto the cathodic strip. Such precipitated metal particles are entrapped within the plate thus causing the undesirable roughness. The novel bath of this invention operates at a significantly lower pH range and thus the rise in pH of the cathodic film causing this problem is avoided.

In continuous strip-plating, it has been noticed that very high current-densities occur at the edges of the strip. In rack-plating such high current densities are influenced by the geometry of the part being plated and the geometric configuration of the anode to cathode spacing. A common test for the evaluation of the "burning" capacities of plating baths is by use of the Hull Cell. This is a well known laboratory technique in which the surface of a panel is exposed to a variable current density across the width of the panel being plated. The geometry of the cell produces this effect. The current range within the Hull Cell ranges from the highest current tested to the lowest current, often approaching zero current density in certain areas. The Hull Testing Cell is described in "Metal Finishing Guidebook" (ASM) 1968 edition at page 419. The Hull Cell has been described in expired U.S. Pat. No. 2,149,344.

A series of tests were prepared wherein the Hull Cell was filled with samples of the plating electrolytes according to the above-mentioned prior art and according to the present invention. In the cells utilizing the prior-art electrolytes a nodular treeing affect was noted at the edges of the samples at areas having the higher current-density ranges. There was also considerable evidence of burning. However the baths according to the present invention clearly showed little or no burning at comparable current densities and particularly within the preferred and usually occuring plating conditions as found at or near the edges of continuous plated-strips. Thus the bath according to the present invention reduces the tendency for "burning" at the edges of the continuous plated-strips and thus the novel process of this invention provides a more uniform product.

It has been noted that alloy strips very quickly become covered with a dark stain if the strips are exposed to the air while wet with plating solution. The same coloration was also noted when the strip was immersed in the bath without or at very low plating current. It was determined some time ago that the active agents in causing the stain were the nickel salts present in the plating bath and that apparently the stain is an immersion-deposit of dark colored nickel on the alloy-coated surface. We have found that when the novel bath according to the present invention is used the degree of coloration is considerably reduced and is often not visually apparent. As the present novel plating bath contains appreciably less nickel in solution than was present in the baths formerly used and as the proportion of nickel to the zinc is now much lower, there is less local deposition of the colored immersion nickel and thus the novel plating baths of the present invention reduce the amount of staining of the plated strip and other plated composites to within acceptable limits.

In addition, according to another aspect of this invention, we have discovered that when steel objects are immersed in novel plating bath according to this invention and when the objects are rendered cathodic in such a bath at a very low current density, below about 10 amperes per square foot, that essentially pure nickel is deposited on to the substrate from the baths according to this invention. Thus it is possible with the novel electroplating electrolyte baths of the present invention to first deposit the very thin nickel strike layer which improves the corrosion resistance of the subsequently deposited alloy nickel/zinc and then, after the strike layer of sufficient thickness has been deposited, to then increase the current density and then from the same composition bath to deposit the nickel/zinc alloy of the desired composition; i.e. containing less than 13% nickel, the balance being zinc.

This is a useful expedient inasmuch as it reduces the requirement for two separate plating solutions; i.e. one a nickel "strike" plating solution and then the solution from which the nickel/zinc alloy is plated.

According to this aspect of the invention a method is provided for plating a steel strip with a nickel-zinc alloy coating underlayed by a substantially pure nickel strike or priming coat which comprises the steps of causing the strip to traverse at least one aqueous plating bath having a pH of about 3 to 4 in which soluble nickel salts have been dissolved in amounts sufficient for each gallon of the bath to have a dissolved zinc metal content of about 10 to about 20 ounces per gallon and a dissolved nickel content of from about two to about four ounces per gallon. The nickel and zinc contents are present in the bath in a weight ratio ranging from about 0.1:1 to about 0.45:1. The strip traverses a first section of the squeous bath wherein said strip is cathodic and the current density is maintained in this first section at about up to about a 10 amperes per foot$^2$ thus depositing from said bath essentially pure nickel for the strike layer. The plating of the strike layer is maintained until said nickel layer has a thickness of from about 0.000005 to about 0.00005 inches. Then the strip is advanced to a second section of the bath wherein said cathodic strip is exposed to an electroplating current-density of more than 15 amperes per square foot thereby depositing on the nickel strike layer a nickel/zinc alloy coat layer of about 0.0002 inches in thickness consisting of from 9.5% to 13% nickel with zinc as the remainder. The steel strip is thus provided with an adherent two-layer corrosion-resistant coating, the first layer consisting essentially of nickel up to about 0.00005 inches in thickness and the second layer superimposed thereon of the nickel/zinc alloy, up to about 0.0005 inches in thickness. The combined coating is adherent, suitable for forming operations and has a corrosion resistance measured by the salt spray test, at least twice that obtained with coatings consisting essentially of the nickel/zinc alloy alone.

All of the above advantages, which accrue from the present invention are the result of the process of plating from the novel composition of the present alloy plating bath wherein the zinc and nickel metal ion concentrations vary from that disclosed in the prior art. The present bath has a higher zinc concentration and a much lower nickel concentration. It also provides a higher total metal concentration (nickel plus zinc). These differences from the prior art permit higher operating temperatures during the plating operation, produce a more uniform alloy deposited during and through varying current densities and prove easier to control the formulation of the bath composition during its continuous operation in the continuous strip-plating line.

DETAILED DESCRIPTION OF THE INVENTION

Figure 1:
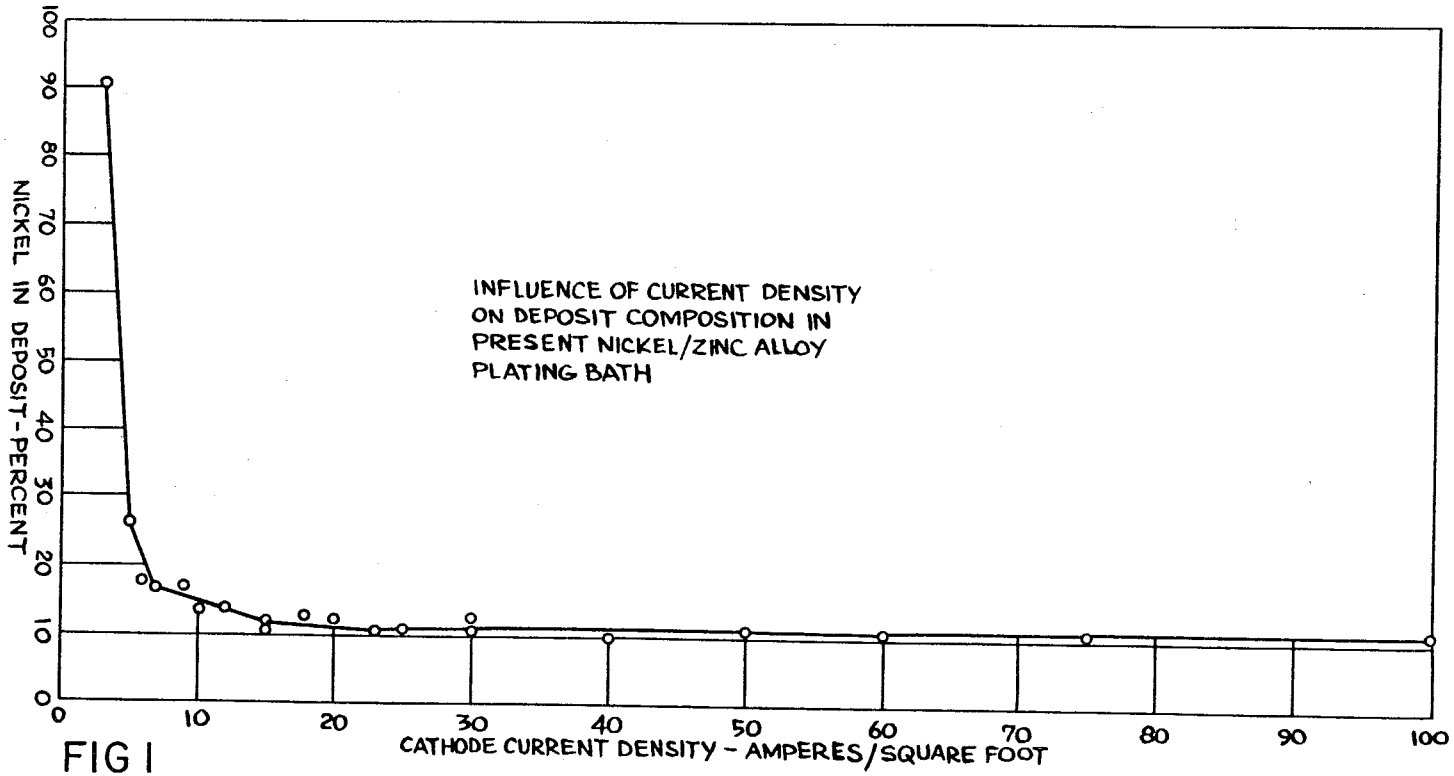

The novel plating electrolytes according to this invention comprise zinc and metal salts dissolved in water. Small amounts of acetic acid are added to this plating electrolyte as a modifying buffer. The pH of the bath is adjusted in the range 3–4.5 by the addition thereto of strong acids such as hydrochloric or sulfuric acid. The choice of adjusting acid is somewhat but not necessarily dependent on the specific nickel and zinc salts used. In addition the electrolyte may contain any of the wetting agents and anti-pitting agents commonly used for such purposes in metal plating baths. These are usually anionic wetting agents and may also include, as preferred anti-pitting surfactants, various long-chain carbohydrate-modified derivatives.

Unless otherwise indicated, the amounts of salts added to the baths are referred to herein in terms of the metal ion equivalent weight per gallon of the plating electrolyte. In general it is preferred to use the more soluble nickel and zinc chlorides but the nickel and zinc sulfates or other soluble salts may be used in equivalent amounts. It is also possible to mix the nickel and zinc chlorides with the nickel and zinc sulfates. The choice of the specific salt is governed by economic considerations and has little or no effect on the plating capacity of the baths according to this invention provided that the total nickel and zinc contents and the ratios of nickel to zinc equivalents are present as stated.

The plating baths according to this invention should have a total metal equivalent ion content of from ten to twenty-five ounces of total metal per gallon of electrolyte. The preferred range of metal is in the range of 14 to 24 ounces per gallon with an optimum operating range of from 15 to 20 ounces per gallon. As the concentration of the metal ions in the electroplating solution varies with the plating rate, the rate of the solution of the soluble metal anodes and replenishment intervals, these concentrations are kept within the preferred range and the optimum range by careful control of the plating current, the pH of the bath and periodic addition of metal salts as required. For the bath to operate properly and over the entire range of operable current densities, the nickel content of the bath should be maintained in the general range of 1.4 to 4.4 ounces per gallon of electrolyte with a preferred range of 2.0 to 4.0 ounces of nickel per gallon and an optimum range of 2.5 to 3.5 ounces per gallon. The zinc concentration is maintained in the range of about 8.0 to about 21 ounces per gallon of electrolyte with the ratio adjusted as stated below.

It is more important for the proper operation of the baths according to this invention that the ratio of nickel to zinc within the total metal concentration of electrolyte lie in the general range of 0.1:1 to 0.4:1 and preferably the ratio should be maintained in the range of 0.2:1 to 0.35:1 with an optimum range of from 0.2:1 to 0.3:1. Within the above described ratio parameter, the most uniform alloy is deposited. This deposit is resistant to burning at high current densities and staining in the event that the electrolyte-coated article is exposed to air in the absence of a plating current.

In order to maintain uniform dissolution of the soluble metal anodes and particularly for maintaining the nickel concentration in the electrolyte, the pH of the electrolyte should be adjusted in the range 2.3 to 4.5 by the careful addition of either sulfuric or hydrochloric acid with hydrochloric acid being the preferred reagent. It is generally preferred to have the bath operate within the pH range of 3 to 4. As a buffer to assist in the maintenance of the pH during the normal variations which occur in plating operations, acetic acid is added to the bath in concentrations within the general range 0.6 to 2.4 volume percent of the bath. It is preferred to have acetic acid present in the concentration range 1.0% to 2% with the optimum concentration being about 1.5 volume/% of acetic acid in the bath. The concentration of acetic acid once added will not vary very much as the concentration of acetic acid is relatively unaffected by the plating currents used herein. The major loss of acetic acid is by slow evaporation at the operating temperature of the bath.

The concentration of wetting and anti-pitting agents in the bath should generally be maintained in the ranges preferred by the industry; i.e. 0.5% to 3.2% by volume of the electrolyte. This is the generally accepted range for such agents in plating electrolytes but varies with the specific agents used.

The nickel and zinc salts used as a source of nickel and zinc ions for the plating of the alloy are either the nickel sulfate ($NiSO_4.6H_2O$) or nickel chloride ($NiCl_2.6H_2O$) and zinc chloride ($ZnCl_2$) or zinc sulfate ($ZnSO_4.7H_2O$) respectively. In addition to these rather inexpensive nickel and zinc salts, it is possible to substitute any of the other water soluble ionizable nickel and zinc salts used in electroplating to provide sources of these metal ions.

There is, in addition to the aforementioned advantages of the present invention, an economic advantage derived from the fact that the concentration of nickel salts in the electroplating bath is lower than in the previously used baths. As the nickel salts are more expensive as compared to zinc salts, their lower concentration in the initial bath provides an economic advantage inasmuch as these baths are usually prepared in quantity for continuous operation in continuous steel strip-plating.

While it is possible, as mentioned above, to electroplate both the nickel strike and the nickel/zinc alloys from a single bath, generally it is preferred to deposit the nickel strike or priming layer from the highly efficient Watt's nickel plating baths. These baths have proven, highly efficient, throwing power. Typical formulae are within the preferred and optimum ranges set forth in Table 1 below:

TABLE 1

| | RANGE | TYPICAL |
|---|---|---|
| Nickel Sulphate ($NiSO_4$-$6H_2O$) | 30–50 oz/gal. (225–375 g/l) | 44 oz/gal. (330 g/l) |
| Nickel Chloride ($NiCl_2$-$6H_2O$) | 4–8 oz/gal. (30–60 g/l) | 6 oz/gal. (45 g/l) |
| Boric Acid ($H_3BO_3$) | 4–5.3 oz/gal. (30–40 g/l) | 5 oz/gal. (37 g/l) |
| Temperature | 110°–150° F. (45°–65° C.) | 140° F. (60° C.) |
| pH | 1.5–4.5 | 3–4 |

These Watt's baths usually also contain proprietary surfactants whose primary purpose is to reduce pitting and also to improve the wetting of the steel strip by the plating solution.

Generally because of their superior throwing power, the Watt's nickel bath formulations as set forth in Table 1 are used but any of several well-known nickel plating baths would also be satisfactory. An all chloride nickel bath has been used but provides no advantages over the Watt's nickel plating bath. (Electroless nickel plating baths may also be used but are not preferred. Vapor phase or vacuum deposition of the nickel priming layer on the substrate may also be used.)

The object to be electroplated; i.e. the steel strip or other iron or steel surface to be protected, is exposed, in the bath to an appropriate current density and time for the desired thickness of the nickel priming layer or strike coat according to the parameters set forth in Table 2 below:

TABLE 2

| Current Density (a.s.f.) | Desired Thickness of Nickel Layer .00001" | .00002" | .00005" |
|---|---|---|---|
| 63.9 amperes/ft.$^2$ | 11.8 sec. | 23.5 sec. | 58.7 |
| 54.8 amperes/ft.$^2$ | 13.7 sec. | 27.4 sec. | 68.4 |
| 45.6 amperes/ft.$^2$ | 16.4 sec. | 32.9 sec. | 82.2 |
| 36.5 amperes/ft.$^2$ | 20.5 sec. | 41.1 sec. | 102.7 |
| 27.4 amperes/ft.$^2$ | 27.4 sec. | 54.8 sec. | 136.9 |
| 18.3 amperes/ft.$^2$ | 41.0 sec. | 82.0 sec. | 204.9 |

The plating rates set forth in Table 2 are based on the normal efficiencies for Watt's nickel plating baths.

As set forth above, the nickel priming or strike layer should range from substantially 0.000005 inches to 0.00005 inches in thickness and preferably should range from 0.00001 inches to 0.00005 inches with an optimum thickness of about 0.00002 inches in thickness. At such a thickness, a more or less continuous layer of nickel is deposited on the steel substrate. We have found that it is preferred to have this nickel layer continuous with a minimum of exposed spots of steel. However, if the discontinuities in the nickel coating are only of a minor or microscopic nature such minor discontinuities have little or no effect on the overall improved corrosion resistance of the final composite.

The steel object after deposition of the nickel prime or strike layer may be rinsed prior to plating with the nickel/zinc alloy of the desired thickness layer. Both or either electroplating operations may be performed either in static baths or in continuous strip-plating arrangements. The nickel/zinc alloy is plated from plating baths formulated according to Table 3.

TABLE 3

| Component | General Range | Preferred Range | Optimum |
|---|---|---|---|
| Ni ++ | 1.4–4.4 oz/gal | 2.0–4.0 | 2.5–3.5 |

TABLE 3-continued

| Component | General Range | Preferred Range | Optimum |
|---|---|---|---|
| Zn ++ | 8.0–20 oz/gal | 10–17 | 11–15 |
| Acetic Acid | 0.6–2.4% | 1–2% | 1.5% |
| pH | 2.3–4.2 | 3–4 | 3.5 |
| Wetting Agent | 0.5%–3.2% | 0.6–2.5% | 1.5%* |

*McGean's Non-Foam 30(0.8%) or Udylite Non-Pitter #22(0.2%)

Generally utilizing the bath as set forth in Table 3 in order to achieve the various thicknesses of the nickel/zinc alloy, the iron or steel substrate should be exposed to the bath at the desired current densities from the times indicated in Table 4.

TABLE 4

| CURRENT DENSITY | THICKNESS OF NICKEL/ZINC ALLOY LAYER .000075" | .0001" | .00015" | .0002" |
|---|---|---|---|---|
| 110 asf | 51.2 sec. | 68.2 sec. | 102.3 sec. | 136.4 sec. |
| 100 asf | 56.3 sec. | 75.0 sec. | 112.5 sec. | 150.0 sec. |
| 90 asf | 62.5 sec. | 83.3 sec. | 125.0 sec. | 166.7 sec. |
| 80 asf | 70.4 sec. | 93.8 sec. | 140.7 sec. | 187.6 sec. |
| 70 asf | 80.3 sec. | 107.1 sec. | 160.7 sec. | 214.2 sec. |
| 60 asf | 93.8 sec. | 125.0 sec. | 187.5 sec. | 250.0 sec. |
| 50 asf | 112.5 sec. | 150.0 sec. | 225.0 sec. | 300.0 sec. |
| 40 asf | 140.6 sec. | 187.5 sec. | 281.3 sec. | 375.0 sec. |
| 30 asf | 187.5 sec. | 250.0 sec. | 375.0 sec. | 500.0 sec. |
| 20 asf | 281.3 sec. | 375.0 sec. | 562.5 sec. | 750.0 sec. |

Figure 2:
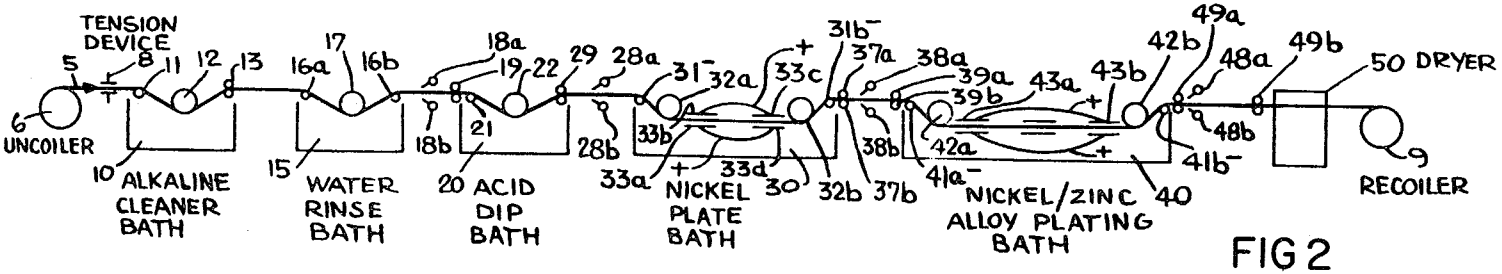

In accordance with the apparatus aspect of the present invention, it is perferred to plate steel strip on the continuous plating line 1 as set forth in FIG. 2.

The continuous plating line 1 consists of steel strip coil 5 mounted on an uncoiler 6 provided with a tension device 8 which guides strip 5 via guide rolls 11 into the alkaline cleaner bath 10. The strip 5 is immersed below the surface of the alkaline cleaner bath 10 via immersion roll 12. To insure proper cleaning it is preferred to make strip 5 anodic by conventional apparatus (not shown). After traverse of the alkaline cleaner bath 10, strip 5 leaves the bath via a set of squeeze rolls 13 which insure that a minimum of the alkaline cleaner bath adheres to strip 5. Strip 5 is then guided via guide rolls 16*a* and 16*b* and immersion roller 17 into water rinse bath 15 to remove any traces of the alkaline cleaner bath solution. On emersion from the water rinse bath, a set of water jets 18*a* and 18*b* provide a final rinse of the strip.

The strip 5 then proceeds through a set of squeeze rolls 19, to remove the rinse water, into acid-dip bath 20 into which it is guided by guide rolls 21 and immersion roll 22. In the acid-dip bath the surface of strip 5 is cleaned, pickled and/or slightly etched by the action of the acid. The strip 5 leaves acid dip bath 20 via a set of squeeze rolls 29 followed by a set of water rinse jets 28*a* and 28*b*, positioned above and below the surface of strip 5, in order to insure removal of any residual acid.

Strip 5 is then introduced into nickel priming plating bath 30 via guide rolls 31 a and first immersion roll 32*a*. Metallic guide rolls 31 in contact with strip 5 are connected to the negative terminal of a dc source (not shown) and thus render strip 5 cathodic during its traverse of the nickel bath 30. The nickel plating bath 30 is provided with metallic nickel anodes 33*a*, 33*b*, 33*c*, and 33*d*. These are the nickel replenishing anodes of the bath and are connected to the positive terminal of the dc generator (not shown). After traversing the length of the nickel plating bath 30, steel strip 5 then passes immersion roll 32*b* and proceeds to guide roll 31*b* and passes through squeeze rolls 37*a* and 37*b* on leaving the bath. These squeeze rolls 37*a* and 37*b* insure that a minimum of the plating bath electrolyte adheres to the strip. Any remaining nickel electrolyte is washed from the top and bottom surfaces of the strip 5 by water rinse jets 38*a* and 38*b*. The strip then traverses squeeze rollers 39*a* and 39*b* to remove any residual water.

Strip 5 then proceeds to the nickel/zinc alloy plating bath 40 via guide rollers 41*a* and immersion roller 42*b*. Guide rollers 41 are connected to the negative terminal of a dc generator (not shown) and then cathodic strip 5 is immersed below the surface of the alloy plating bath via immersion roller 42*a*. Strip 5 is maintained during its traversal of plating bath 40 below the surface of the electrolyte in bath 40 and at a proper distance from the soluble zinc and nickel anodes 43*a* and 43*b* which are all connected to the positive terminal of the dc generator by immersion rollers 42*a* and 42*b*. Soluble nickel and zinc anodes, which are connected to the positive terminal of the dc generator, are positioned and distributed in suitable positions throughout the alloy plating bath 40 in order to maintain a substantially constant and balanced metal ion composition of bath 40. The distances between steel strip 5 and the soluble anodes 43 is adjusted to provide a substantially uniform current density on the surface area of strip 5 during its traversal of the alloy plating bath 40. After traverse of the plating bath, the strip 5 is guided via immersion roll 42*b* to cathode-connected guide roll 41*b* and leaves the bath to pass through the set of squeeze rolls 49*a*. After squeeze rolls 49*a*, strip 5 is subjected to water rinse jets 48*a* and 48*b* to wash off any residual alloy-plating electrolyte and then proceeds via squeeze rolls 49*b* to dryer 50 wherein the washed composite plated strip 5 is dried and from which it is led to strip recoiler apparatus 9.

As an example of the operation of the continuous plating line 1, to obtain a continuous strip plating composite having an optimum nickel undercoating of approximately 0.00002 inches in thickness and a nickel/zinc alloy plate coating on the nickel underplate with a desired thickness of 0.0001 inches, the length of strip 5 should be exposed to nickel plating bath 30 at a current density of 45.6 amperes/ft$^2$ for 32.9 seconds. As the exposed length of the strip in the specific apparatus is 18.25 feet, the line speed of strip 5 is approximately 33 feet per minute. Being a continuous operation, the strip traversal speeds must be equal in both the nickel plating and alloy plating steps. However, the current density can be varied in each of nickel plating bath 30 and alloy plating bath 40 to meet the desired thickness requirements of the dual coating.

In order to utilize the same electrolyte in both the nickel plating bath 30 as is used in alloy plating 40, in accordance with one of the optional aspects of the present invention, it is possible to lengthen the nickel plating bath so that the strip 5 can traverse the bath at lower current densities for a greater period of time in order to maintain the plating conditions below about 10 amperes per square foot to insure a substantially pure deposition of nickel from the same novel bath as is used for alloy deposition at higher current densities above about 30 amperes per square foot.

Example 1, below, provides an example of the preferred mode of practice using the novel alloy plating bath 40 as described above and under the preferred processing parameters described in conjunction with the deposition of the nickel undercoat via a Watt's nickel plating bath in nickel plate bath 30.

EXAMPLE 1

Into the continuous plating apparatus according to FIG. 2 the steel strip was first fed into the alkaline cleaning bath containing approximately 2,000 gallons of an alkaline cleaner consisting of six ounces to the gallon of a proprietary alkaline cleaner compound (Gillite 0239 Alkaline cleaner) containing 1.25 ounces per gallon of sodium hydroxide maintained at 190° F. The strip was passed through the bath at 33 feet per minute. Its immersed strip length was 17 feet. The cleaning action was augmented by making the strip anodic at a current density of 20 to 30 amperes per amperes/ft$^2$. From this bath, after suitable washing and rinsing, the strip was then introduced into the acid pickling bath having a volume of approximately 1,000 gallons. The bath contained 5% by volume of sulfuric acid at a temperature of about 150° F. The strip, of course, traversed the bath at 33 feet per minute. Its immersed strip length was 13 feet.

After suitable rinsing, the cleaned strip was introduced into the nickel "strike" bath of 3,000 gallon volume, maintained at 140° F. The anode bed length; i.e. the effective electrolytically-exposed length of the strip was 18.25 feet. A "strike" nickel coating of approximately 0.00002" in thickness was deposited at a current density of 45.6 amperes/ft$^2$ in the 32.9 seconds of exposure of the strip to the anode bed length. This bath contained 44 ounces per gallon of nickel sulfate, 6 ounces per gallon of nickel chloride, 5 ounces per gallon of boric acid and 0.8% by weight of McGeans Non-Foam-30 (wetting agent) all dissolved in water.

After completion of the nickel strike followed by suitable rinsing of the strike bath from the strip, the strip was introduced into the nickel/zinc lined bath maintained at 130° F.–145° F. The nickel/zinc plating tank has a volume of approximately 11,000 gallons and its length is approximately 100 feet. The effective anode bed length to which the strip is exposed is approximately 65 feet. The strip was passed through the bed at the set rate of 33 feet per minute and the nickel/zinc alloy was plated on the nickel-coated strip to a thickness of 0.0001 inches at a current density of 56.7 amperes/ft$^2$ for a time of 118.2 seconds.

After washing and drying the composite-plated strip, test sections were cut and subjected to the standard Neutral Salt Spray Test in accordance with ASTM B117. The corrosion rate of the nickel/zinc alloy layer in the "strike" containing composite was at the rate of 1.28 hours per microinch of alloy thickness. Standard nickel/zinc alloy layers applied directly steel substrates tested in the corrosion chamber at the same time showed corrosion rates of 0.56 hours per microinch. Thus, the products of the present process exhibited at least twice the corrosion-resistance rate as the products prepared from the same alloy plating baths without the nickel strike layer.

It is understood that changes within the stated parameters may be made in the preferred method and in the compositions and treating conditions and of products as described without departing from the spirit of the invention or the scope of the appended claims.

We claim:

1. An apparatus for the continuous plating of corrosion resistant coatings on iron or steel strip substrates which comprises, in combination, a plating line including a seriatim arrangement of cleansing and plating tanks, liquid segregation means between said tanks,
and strip propulsion and advancing means;
said plating tanks including
a first nickel plating section fitted with nickel anodes and filled with a nickel ion-containing electrolyte and means for making said strip cathodic to deposit a substantially pure nickel priming layer on said strip,
and a second alloy plating section fitted with zinc and nickel anodes and filled with an electrolyte maintained at a temperature range of 135° F. to 145° F., said electrolyte containing nickel and zinc ions,
wherein the combined metal ion-content of nickel and zinc in the electrolyte is in the range of 10 to 25 oz/-gal, the ratio of nickel to zinc in the electrolyte is in the range of 0.1 to 1 to 0.4 to 1 and the nickel ion content is in the range 1.4 to 3.5 oz/gal,
said alloy plating section containing means for making said strip cathodic and providing a cathodic current density to said strip in the range of 15 to 120 amperes per square foot of strip;
whereby the strip, after cleansing is advanced by said propulsion means to said first nickel plating section for the application of a nickel priming layer and then is advanced to said second section where said primed strip is then coated with a corrosion-resistant electrodeposited layer of a nickel/zinc alloy having a content of 10% to 14% nickel, the balance being zinc,
wherein said first plating section and said second plating section are successive sections of a contiguous plating tank both sections of which are filled with the electrolyte of said second section, and wherein the current density in said first section is adjusted by said cathodic making means at less than about 10 amperes per square foot, then rising up to 15 to about 120 amperes per square foot for the subsequent alloy deposition.

2. The apparatus according to claim 1 wherein said first section deposits the nickel layer at a thickness of from about 0.000005 to about 0.00005 inches and the second section deposits the nickel/zinc alloy layer at a thickness of from about 0.0002 inches to about 0.0005 inches.

3. The apparatus according to claim 2, wherein said strip propulsion and advancing means advancing the strip at a continuous speed through said plating bath and through said first and second sections and the plating thickness is adjusted by adjusting the length of section traversed, the current density, and the areas of applied current densities, to provide sufficient plating time in said sections to result in said thicknesses within each section.

* * * * *